United States Patent [19]

Scapecchi et al.

[11] Patent Number: 4,889,086

[45] Date of Patent: Dec. 26, 1989

[54] AUTOMATIC TIMING VARIATION DEVICE FOR AN INTERNAL COMBUSTION ENGINE

[75] Inventors: Pier L. Scapecchi, Saronno; Giovanni Coghi, Gerenzano; Paolo Lanati, Piacenza, all of Italy

[73] Assignee: Alfa Lancia Industriale S.p.A., Arese, Italy

[21] Appl. No.: 343,288

[22] Filed: Apr. 26, 1989

[30] Foreign Application Priority Data

May 5, 1988 [IT] Italy ..... 20464 A/88

[51] Int. Cl.[4] ..... F01L 1/34

[52] U.S. Cl. ..... 123/90.15; 123/90.31

[58] Field of Search ..... 123/90.12, 90.15, 90.17, 123/90.31

[56] References Cited

U.S. PATENT DOCUMENTS 4,231,330 11/1980 Garcea ..... 123/90.15
4,421,074 12/1983 Garcea et al. ..... 123/90.15
4,535,731 8/1985 Banfi ..... 123/90.17
4,601,266 7/1986 Oldfield et al. ..... 123/90.15
4,787,345 11/1988 Thoma ..... 123/90.17
4,811,698 3/1989 Akasaka et al. ..... 123/90.17

FOREIGN PATENT DOCUMENTS 0147209 7/1985 European Pat. Off. .
2526858 5/1983 France .

*Primary Examiner*—Charles J. Myhre
*Assistant Examiner*—Weilun Lo
*Attorney, Agent, or Firm*—Charles E. Brown; Charles A. Brown

[57] ABSTRACT

The proposed device comprises a cylinder rigid with a camshaft drive pulley, and a piston restrained to said cylinder and camshaft by helical groove connections and prismatic pair connections which, on command, allow said camshaft to undergo rotation relative to said pulley.

11 Claims, 2 Drawing Sheets

AUTOMATIC TIMING VARIATION DEVICE FOR AN INTERNAL COMBUSTION ENGINE

This invention relates to a device for automatically varying the timing, or angular position, of a camshaft relative to the crankshaft of an internal combustion engine, and specifically a device comprising a cylinder rigid with a pulley rotated by the crankshaft, and a piston provided with restraint means which keep said piston normally rotationally rigid with said cylinder and with said camshaft while allowing it to undergo axial movement relative to said cylinder and camshaft and to undergo rotation relative to said cylinder, said device also comprising valve means arranged to feed and discharge pressurised fluid to and from said cylinder and controlled by a control center in accordance with chosen engine parameters.

In internal combustion engines the timing of the camshafts and hence of the intake and exhaust valves is optimised for a determined engine speed, and in the case of fixed timing it is hardly adequate and sometimes only just acceptable at other speeds.

Consequently either a compromise value is adopted or devices are used which enable it to be automatically vaired in either a continuous or discrete manner.

Devices able to continuously vary the timing are generally fairly complicated, while the discrete variation types are more simple but still fairly satisfactory because they enable timing values to be used which are optimised for one or other region of the engine operating range.

At idling and at low loads the cross-over (simultaneous opening of the intake and exhaust valves) must be short to prevent the exhaust gas flowing back into the explosion chamber or into the intake ducts by virtue of the intake vacuum and/or the exhaust overpressure.

The main advantage obtained by short cross-over is reduction in fuel consumption, reduction in harmful exhaust emission, and uniform engine idling.

At high speed under full admission conditions a long cross-over is necessary to improve cylinder filling by utilizing the inertia and resonance of the fluids in the intake and exhaust ducts.

Finally, at close to maximum speed under full admission conditions it is advantageous to considerably retard the closure of the intake valves to exploit the inertia and resonance of the fluid in the intake ducts.

The benefits are a higher torque, high maximum power and optimized fuel consumption.

Discrete control devices of this type are described in Italian Pat. Nos. 1,093,715 and 1,152,959 of the present applicant. The object of the present invention is to provide an automatic timing variation device for an internal combustion engine which as in the case of those of the cited patents is particularly efficient and reliable but which is considerably simpler in its design and assembly, is of reduced overall size, weight and cost, and provides considerable timing accuracy.

This is attained by a device of the initially described type, characterised in that said restraint means consist of helical groove connections and prismatic pair connections.

Preferably, said helical groove connections are interposed between said cylinder and piston, and said prismatic pair connections are interposed between said piston and said camshaft.

The result is a particularly satisfactory device in terms of compactness, fast response and accurate assembly.

Characteristics and advantages of the invention are described hereinafter with reference to the accompanying FIGS. 1 to 4 which show a preferred embodiment of the invention by way of non-limiting example, FIG. 1 is a partial axial section through a timing variation device according to the invention;

Figure 1:
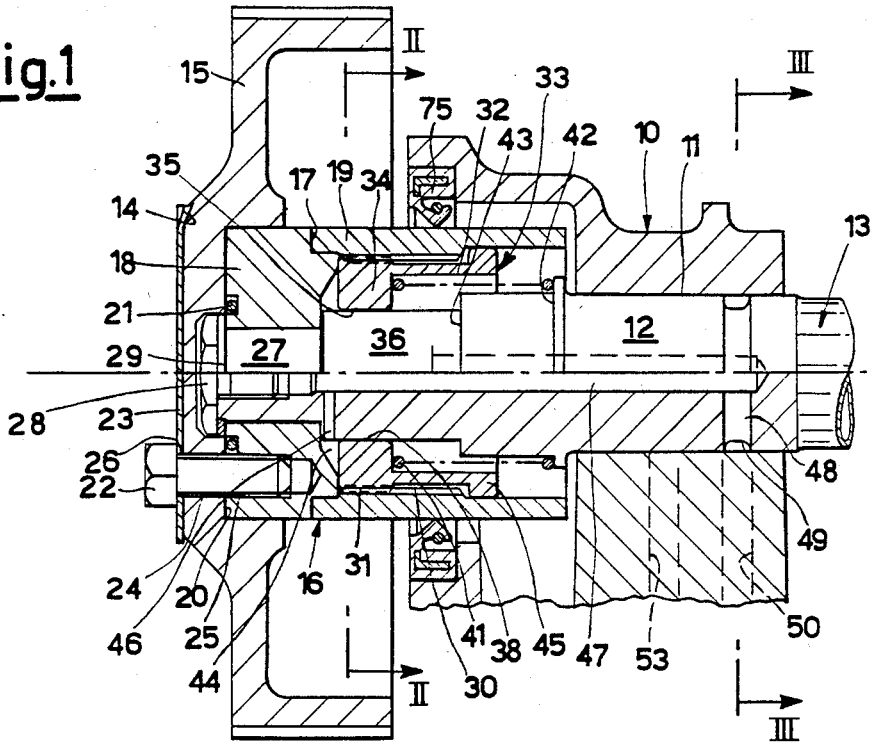

In FIG. 1 the reference numeral 10 indicates overall an internal combustion engine head, only part of which is shown. In the engine head there is provided a bearing 11 which supports a journal 12 of the camshaft, which is indicated overall by 13 and also shown only partly. The camshaft 13 is for example that which controls the engine intake valves.

The reference numeral 15 indicates a toothed pulley which is rotated by the crankshaft, not shown, by way of a toothed belt, also not shown.

The reference numeral 16 indicates overall a cylinder formed from an annular end wall 18 and a cylindrical side wall 19 welded at 17, for example by a laser process.

This enables the inner surfaces of the wall 19 to be machined to design precision and tolerances before fixing to the wall 18.

The cylinder 16 is housed in a suitable seat 20 of the pulley 15 by way of a seal ring 21, and its end wall 18 is fixed to the pulley 15 by screws such as that indicated by 22, by way of a safety plate 23 between the screw heads and the pulley 15. The pulley 15 comprises slots 24 such as that shown in FIG. 1, which correspond to threaded bores 25 in the wall 18 and holes 26 in the safety plate 23 to allow precise adjustment of the timing of the camshaft 13 with respect to the pulley.

To ensure that the timing obtained on locking the cylinder 16 to the pulley 15 is maintained, the plate 23 is upset after assembly into a suitable seat 14 in the pulley 15.

The cylinder 16 is supported rotatably in a cantilever manner by a portion 27 of the journal of the camshaft 13 by way of its annular end wall 18, and is fixed axially to said camshaft 13 by a screw 28 and a washer 29.

Figure 4:
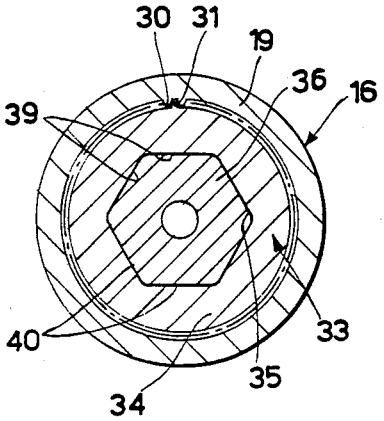
FIG. 4 is a modification of the detail of FIG. 2.
Figure 2:
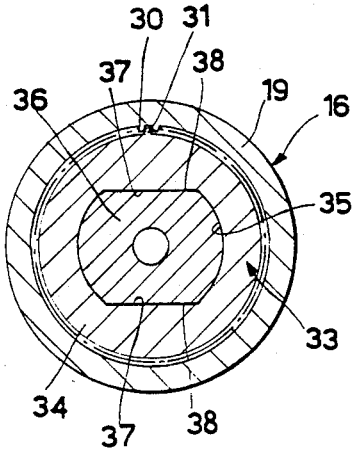
FIG. 2 is a partial section on the line II—II of FIG. 1.

The side wall 19 of the cylinder 16 is provided internally with helical grooves 30 which engage corresponding helical grooves 31 provided in the skirt 32 of a piston indicated overall by 33. The head 34 of the piston 33 is annular and is provided with a bore 35 arranged to engage a portion 36 of the journal of the camshaft 13. The bore 35 comprises at least two preferably opposing flat walls 37 which engage corresponding flat walls 38 of the portion 36 to form prismatic pairs, as shown in FIG. 2. The bore 35 and portion 36, which have transverse dimensions greater than the portion 27, can be provided with several engageable flat surfaces, such as those indicated respectively by 39 and 40 in FIG. 4, which shows an embodiment in which said bore 35 and portion 36 are of hexagonal cross-section.

The reference numeral 41 indicates a spring, interposed between the head 34 of the piston 33 and a shoulder 42 on the camshaft 13, to urge said piston against the end wall 18 of the cylinder 16, the reference numeral 43 indicating a further shoulder on the camshaft 13 acting as a travel stop for the piston 33.

A variable-volume chamber indicated by 44 is enclosed between the head 34 of the piston 33 and the walls 18 and 19 of the cylinder 16.

The chamber 44 is sealed by virtue of the tolerance used for the contacting surfaces of the walls of the bore 35 and portion 36 and for the surfaces of the wall 19 of the cylinder 16 and the annular projection 45 on the skirt 32 of the piston 33. In addition, any seepage of oil to the outside of the cylinder 16 is retained by a ring (of "corteco" oil lip seal type) 75 fixed in a suitable seat in the head 10.

The chamber 44 communicates with a diametrical duct 46 provided in the camshaft 13 and branching from an axial duct 46 also provided in said camshaft 13.

Figure 3:
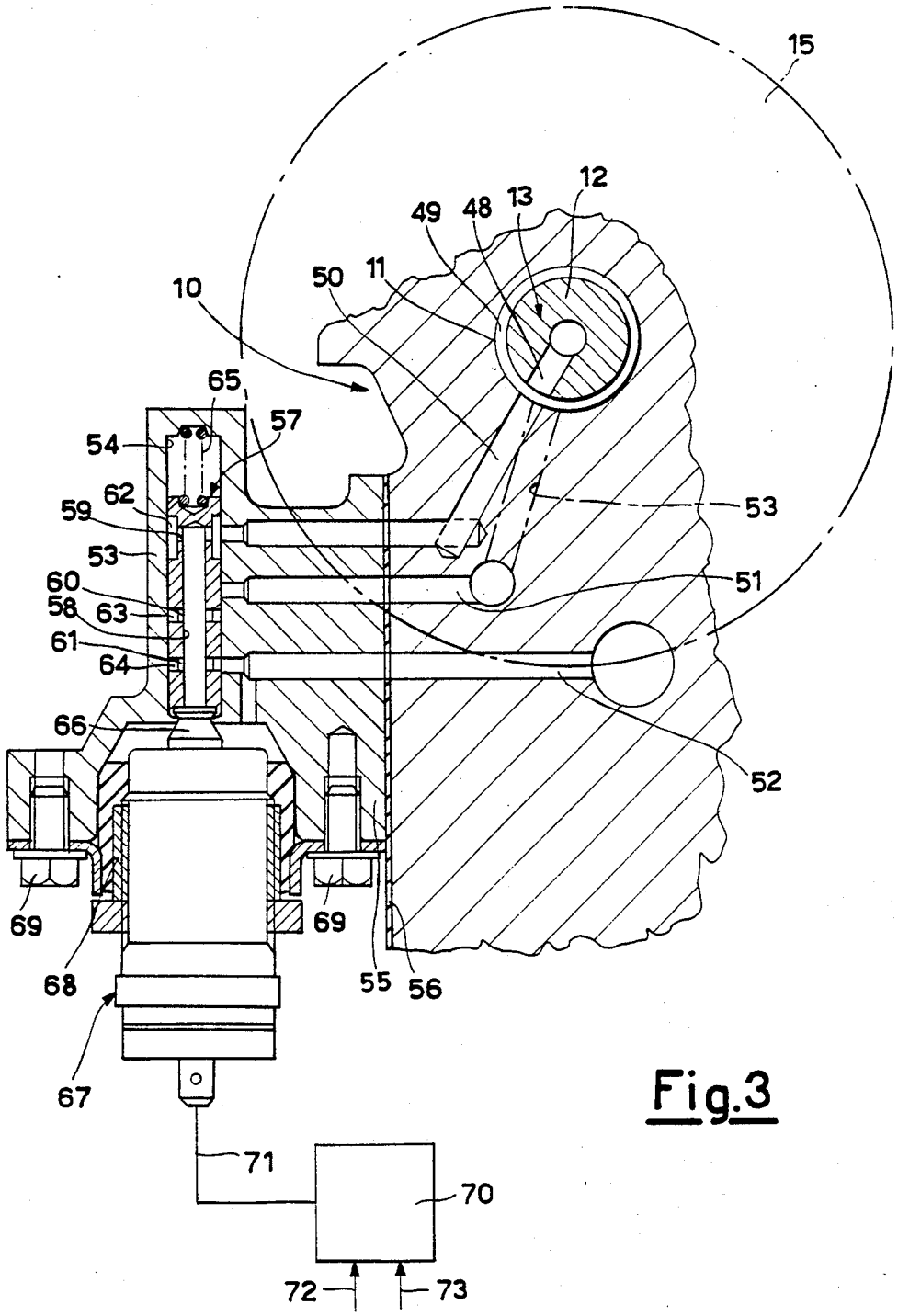
FIG. 3 is a partial section on the line III—III of FIG. 1.

The duct 47 communicates by way of a duct 48 and an annular chamber 49 with a duct 50 provided in the engine head 10 as shown in FIG. 3.

The duct 50 can be connected to a feed duct 51 which receives pressurised oil from the engine lubrication circuit, and to a discharge duct 52.

In FIGS. 1 and 3 the reference numeral 53 indicates a lubrication circuit duct which feeds oil to the bearing 11.

The ducts 50, 51, 52 communicate with corresponding ducts which open into a cylindrical cavity indicated by 54 and provided in a structure 55 fixed to the head 10 by way of a seak gasket 56.

A slide valve indicated overall by 57 is slidingly mounted in the cavity 54 to control communication between the ducts 50, 51, 52. The slide valve 57 comprises an internal cylindrical chamber 58 which communicates with annular chambers 62, 63, 64, by way of radial ducts 59, 60, 61.

The slide valve 57 is balanced because the forces exerted by the oil on its walls have a zero resultant.

The slide valve 57 is engaged by a spring indicated by 65 and a push rod indicated by 66 and operationally connected to the armature, not shown, of an electromagnet indicated overall by 67. The electromagnet 67 is fixed to the structure 55 by a rubber-metal sleeve 68 and screws 69.

The electromagnet 67 is operationally connected, by a line 71, to a control center 70 in the form for example of a programmed microprocessor. Signals indicative of chosen engine operating parameters such as engine r.p.m., throttle valve angle or angles, intake vacuum and intake air throughput, these being represented by the arrows 72 and 73, are fed to the control center 70. The control center 70 feeds no control signal to the electromagnet 67 until it senses that the chosen engine parameters, such as r.p.m., throttle valve angle or angles or air throughput are below predetermined threshold values.

While the electromagnet 67 is deactivated the push rod 66 remains in its retracted position and the slide valve 57, under the action of the spring 65, assumes a first operating position as shown in FIG. 3, in which it connects the duct 50 to the discharge duct 52.

Thus the chamber 44 of FIG. 1 is also connected to discharge and the piston 33 is urged by the spring 41 against the wall 18 of the cylinder 16, to assume a first end-of-travel position, as shown in FIG. 1.

Under these conditions the piston 33 effects a first timing, or angular position, between the camshaft 13 and pulley 15. Preferably this first timing is optimised for low r.p.m. values and reduced loads, and if the camshaft 13 is that which controls the engine intakes valves, it can be chosen to provide minimum cross-over with the exhaust valves, so regularizing the engine operation under these conditions.

The control center 70 feeds a control signal to the electromagnet 67 when it senses that the chosen engine parameters exceed said predetermined threshold values.

The electromagnet 67 is activated and its armature urges the push rod 66 outwards so that it moves the slide valve 57 into a second operating position against the action of the spring 65, to connect the duct 50 to the feed duct 51 by way of the annular chamber 63. The chamber 44 of FIG. 1 is thus connected to the pressurised oil feed and the action of the oil urges the piston 33 against the shoulder 43, overcoming the action of the spring 41.

When the piston 33 slides axially to the cylinder 16 and camshaft 13, it also rotates within the cylinder 16 because of the connection formed by the helical grooves 30 and 31, until it reaches its second end-of-travel position against the shoulder 43. As the piston 33 rotates, it rotates the camshaft 13 because of the connection formed by the engaging flat walls 37, 38 or 39, 40. Under these conditions, the piston 33 effects a second timing, or angular position, between the camshaft 13 and pulley 15.

This second timing value can for example be optimised for high-load r.p.m. values corresponding to maximum torque. Thus if the camshaft 13 is that which controls the intake valves, this value can be chosen to provide lengthy cross-over with the exhaust valves to exploit the inertia and resonance of the fluid column passing through the intake and exhaust ducts, to improve cylinder scavenging and filling with fresh charge under said conditions. With the proposed device it is possible to effect a third timing, equal to said first, for r.p.m. values and loads corresponding to maximum power.

In this case the control center 70 senses passage through further predetermined threshold values of the chosen engine parameters and interrupts the feed of said control signal to the electromagnet 67, so that the slide valve 57 returns to its first operating position under the action of the spring 65, to connect the chamber 44 to discharge 52.

The piston 33 is urged by the spring 41 against the wall 18 of the cylinder 16, and the camshaft 13 returns to assume said first timing value.

This timing results in a retardation in the closure of the intake valves, which enables the inertia and resonance of the fluid present in the intake ducts to be exploited to increase cylinder filling under said maximum power conditions.

The described device was various advantages by virtue of its very simplified design and assembly, its minimised size, weight and cost, its efficiency, a particularly rapid response and its reliability. It also allows very precise adjustment of the timing between the camshaft 13 and pulley 15.

A further advantage of the device is its considerable flexibility, enabling it to be used on engines in which the camshaft is either toothed-belt or chain driven.

What is claimed is:

1. A device for automatically varying the timing, or angular position, of a camshaft (13) relative to the crankshaft of an internal combustion engine, comprising a cylinder (16) rigid with a pulley (15) rotation by the crankshaft, and a piston (33) provided with restraint means which keep said piston (33) normally rotationally rigid with said cylinder (16) and with said camshaft (13)

while allowing it to undergo axial movement relative to said cylinder and camshaft and to undergo rotation relative to said cylinder, said device also comprising elastic means (41) engaged with said piston (33) to retain it in a first end-of-travel position, and valve means (57) arranged to feed and discharge pressurized fluid to and from said piston (33) in order to move it between said first end-of-travel position and a second end-of-travel position and controlled by a control center (70) in accordance with chosen engine parameters, characterised in that said restraint means consist of helical groove connections (30, 31) and prismatic pair connections (37, 38 or 39, 40).

2. A device as claimed in claim 1, characterized in that said helical groove connections (30, 31) are interposed between said cylinder (16) and piston (33).

3. A device as claimed in claim 1, characterized in that said prismatic pair connections (37, 38 or 39, 40) are interposed between said piston (33) and camshaft (13).

4. A device as claimed in claim 1, characterized in that said cylinder (16) is formed from an annular end wall (18) and a cylindrical side wall (19) rigidly joined together.

5. A device as claimed in claim 4, characterized in that the annular end wall (18) of said cylinder (16) is rotatably supported by a portion (27) of a journal of said camshaft (13).

6. A device as claimed in claim 1, characterized in that said piston (33) is formed from a skirt (32) and an annular head (34) which has a bore (35) engaged with a portion (36) of a journal of said camshaft (13).

7. A device as claimed in claim 6, characterized in that said skirt (32) is provided with helical grooves (31) which engage with corresponding helical grooves (30) formed in the side wall (19) of said cylinder (16).

8. A device as claimed in claim 6, characterized in that the annular head (34) of said piston (33) is provided with a bore (35) having at least two flat walls (37 or 39) engaging corresponding flat walls (38 or 40) provided in the portion (36) of the journal of the camshaft (13).

9. A device as claimed in claim 1, characterized in that said valve means (57) consist of a slide valve having an inner cylindrical chamber (58) connected to a duct (50) which communicates with a chamber (44) lying between said cylinder (16) and piston (33) and connectable to the pressurised fluid feed and discharge ducts (51, 52), the slide valve being engaged with respective elastic means (65) and with a driver electromagnet (67) operationally connected to said control center.

10. A device as claimed in claim 2, characterized in that said prismatic pair connections (37, 38 or 39, 40) are interposed between said piston (33) and camshaft (13).

11. A device as claimed in claim 2, characterized in that said cylinder (16) is formed from an annular end wall (18) and a cylindrical side wall (19) rigidly joined together.

* * * * *